US009254935B2

(12) United States Patent
Mothersbaugh et al.

(10) Patent No.: US 9,254,935 B2
(45) Date of Patent: Feb. 9, 2016

(54) BULK MATERIAL HANDLING SYSTEM AND CARRIER THEREFOR

(75) Inventors: James E. Mothersbaugh, Muncy, PA (US); Steven S. Kelchner, Turbotville, PA (US); Joseph A. Hauser, Williamsport, PA (US)

(73) Assignee: THE YOUNG INDUSTRIES, INC., Muncy, PA (US)

( * ) Notice: Subject to any disclaimer, the term of this patent is extended or adjusted under 35 U.S.C. 154(b) by 870 days.

(21) Appl. No.: 13/224,391

(22) Filed: Sep. 2, 2011

(65) Prior Publication Data

US 2013/0058744 A1 Mar. 7, 2013

(51) Int. Cl.
*B66C 1/22* (2006.01)
*B65B 69/00* (2006.01)

(52) U.S. Cl.
CPC ..... *B65B 69/0083* (2013.01)

(58) Field of Classification Search
CPC ..... B66C 1/226
USPC ..... 294/67.33, 68.3; 414/415
See application file for complete search history.

(56) References Cited

U.S. PATENT DOCUMENTS 4,966,311 A * 10/1990 Taylor ..... 222/105
5,788,449 A * 8/1998 Riemersma ..... 414/415
6,186,360 B1 * 2/2001 Becker et al. ..... 222/1
7,223,058 B2 * 5/2007 Nyhof ..... 414/415

* cited by examiner

*Primary Examiner* — Jonathan Snelting
(74) *Attorney, Agent, or Firm* — Novak Druce Connolly Bove + Quigg LLP

(57) ABSTRACT

A compact, portable carrier for a flexible bag containing a comminuted material and having a bottom discharge spout, including a frame structured to encompass such bag and attach such bag in suspended relation thereto, be transported to a spaced site and be operated to jostle the material contained in such suspended bag to facilitate the discharge thereof through the spout thereof.

7 Claims, 4 Drawing Sheets

BULK MATERIAL HANDLING SYSTEM AND CARRIER THEREFOR

This invention relates to a bulk material handling system and more particularly to such a system having means for enhancing the discharge of such a material from a container thereof into a bin or hopper. This invention further provides for a novel carrier for such a system including means for enhancing such discharge of material.

BACKGROUND OF THE INVENTION

Bulk comminuted materials typically are deposited in bags formed of a flexible material which commonly are stored on pallets, transmitted by means fork lift trucks and/or overhead cranes and deposited in various bins or hoppers for blending, processing or other purposes. Generally, such bags include a peripheral wall, a closable top wall provided with a set of looped straps and a bottom wall including a spout which may be tied closed for storing and transportation purposes. In circumstances where the contents of such bags are to be fed into a bin or hopper for storage, blending, processing or other purposes, they are suspended from a carrier by means of the looped straps thereof, connected to a hook of an overhead crane, transported by such crane to and positioned over an inlet of a selected bin or hopper and opened to permit the contents thereof to be gravity discharged into the selected bin or hopper.

Often, the material thus being transported and charged into a bin or hopper, has poor flow properties which impair or possibly prevent the free gravity discharge of such material from the bag. To contend with such occurrences, many of such bins or hoppers in which some materials are to be fed are provided with various means for jostling such bags positioned over such bins or hoppers to dislodge and impel the material and thus enhance its flowability in discharging such material from such bags. Such jostling means may consist of any form of device which impacts a bag being emptied to dislodge and propel the contents of the bag through the spout thereof.

In the use of such jostling devices for the purpose as described, it has been found that the provision of such devices on each bin or hopper in which bags are to be emptied can be costly and often impractical or impossible to provide because of space limitations. Accordingly, the general object of the present invention is to provide an improved system for handling a bulk comminuted material utilizing flexible bags for holding and carrying a material to be transferred to a receptacle, and an improved carrier for use in such a system, which is more effective and economical in use.

SUMMARY OF THE INVENTION

The principal object of the present invention is achieved by providing a system comprising a receptacle having an inlet for receiving a bulk material therethrough, and a carrier for supporting a flexible bag with a closable discharge spout containing a bulk material to be deposited in such receptacle, and means operable upon a bag loaded with bulk material being supported thereon, with the spout of the bag being aligned with such receptacle inlet and the spout thereof being open for jostling such bag to enhance the discharge of the material through such spout into the receptacle, wherein such carrier and such receptacle are provided with cooperating configurations facilitating the positioning of the lower end of such bag relative to such receptacle with the spout of such bag being aligned with the receptacle inlet. Such objective further is realized by the use of a carrier for a flexible bag containing a bulk comminuted material, having means for support on such carrier and a spout at a lower end thereof for discharging such material therefrom, generally comprising a frame having a lower open end and means cooperable with such support means of such bag for mounting said bag thereon with the tower end of said bag vertically aligned with the lower end of such frame, means disposed on such frame cooperable with a transporting means for displacing such frame and means mounted on such frame having means enagageable with a bag supported on such frame for selectively jostling such supported bag to enhance the flow and discharge of material within such bag through the spout thereof.

DETAILED DESCRIPTION OF THE PREFERRED EMBODIMENTS OF THE INVENTION

Figure 4:
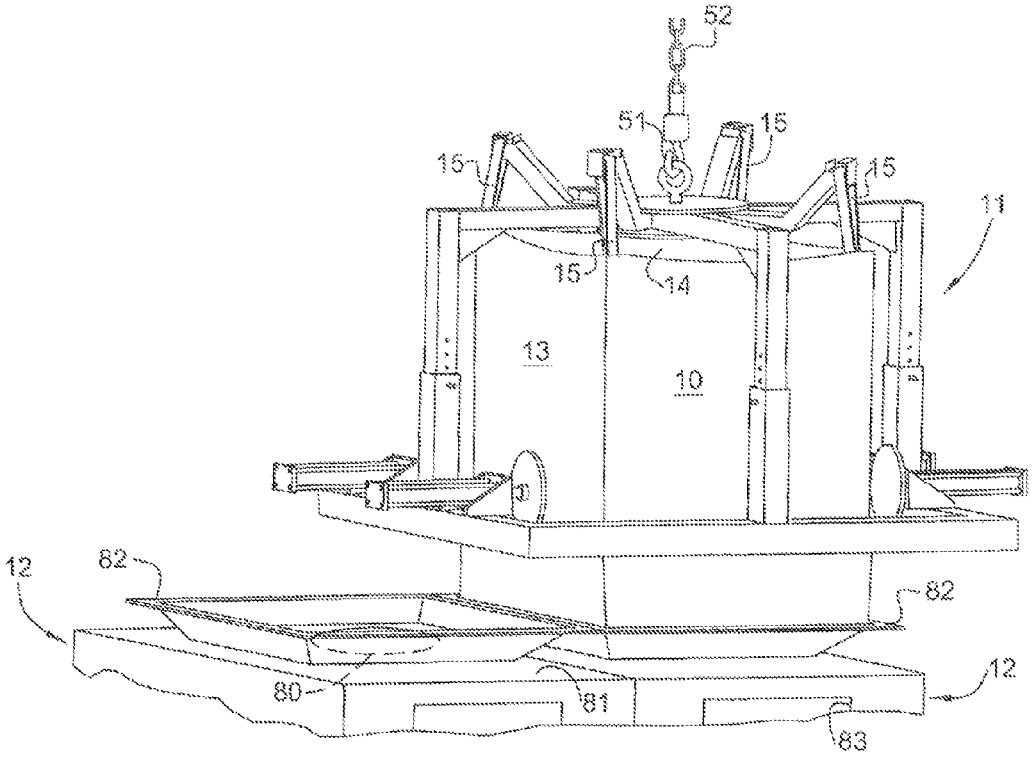
FIG. 4 is a perspective view of the carrier having a bag of bulk, comminuted material suspended therefrom as shown in FIG. 2, positioned over a receptacle for the purpose of discharging the contents of the bag suspended on such carrier.
Figure 5:
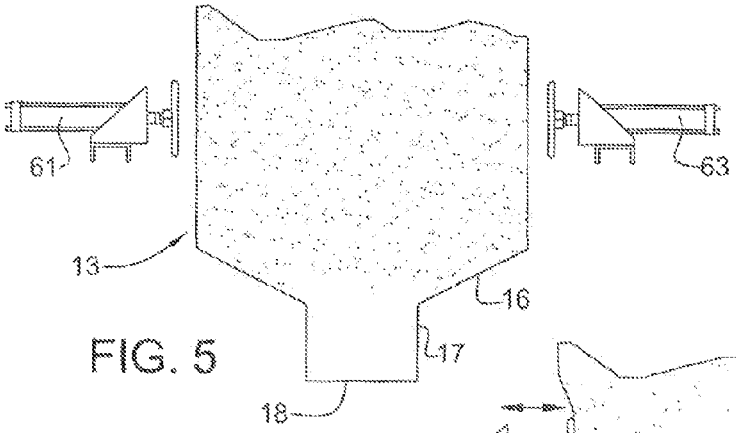
FIG. 5 is a diagrammatic view of a bag as shown in FIGS. 2 and 4 and the relative positions of the jostling devices of the carrier as shown in such views disposed in retracted, non-contacting positions.
Figure 6:
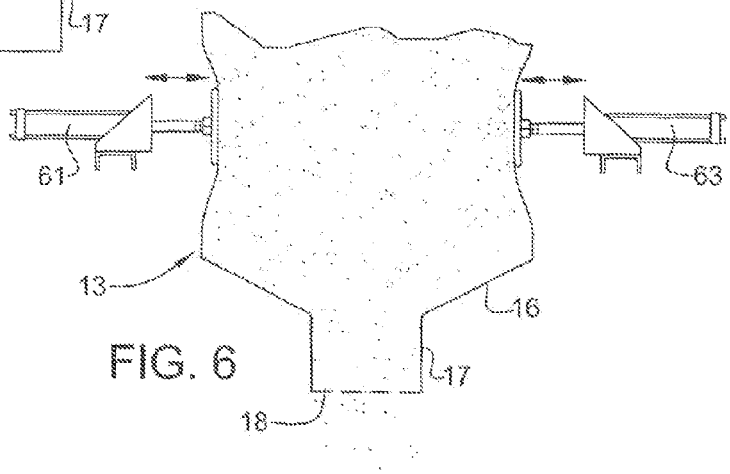
FIG. 6 is a view similar to the view shown in FIG. 5, illustrating the jostling devices in contact with a bag suspended from the carrier shown in FIGS. 2 and 4.

Referring to the drawings, there is illustrated a bulk material handling system for suspending, transporting and emptying a flexible bag 10 containing a comminuted material which includes a carrier 11 for supporting, transporting and positioning such bag over a receptacle 12 for the purpose of gravity discharging the material therefrom and further jostling the contents of such bag to enhance the discharge of such material into the receptacle. Referring to FIGS. 4 through 6; material holding bag 10 consists of a peripheral wall 13 disposable in an expanded condition within carrier 11, a top wall 14 provided with an opening (not shown) through which material to be transported may be introduced into the bag, which may be closed upon introducing such material, and a set of looped straps 15 which may be attached to the carrier for suspending the bag within the carrier, and a lower wall 16 which is sloped when the bag is filled with material toward a spout 17 having an opening 18, which spout may be collapsed, closed and tied to lower wall 16 for retaining material within the bag during storage and transportation of the material.

Figure 1:
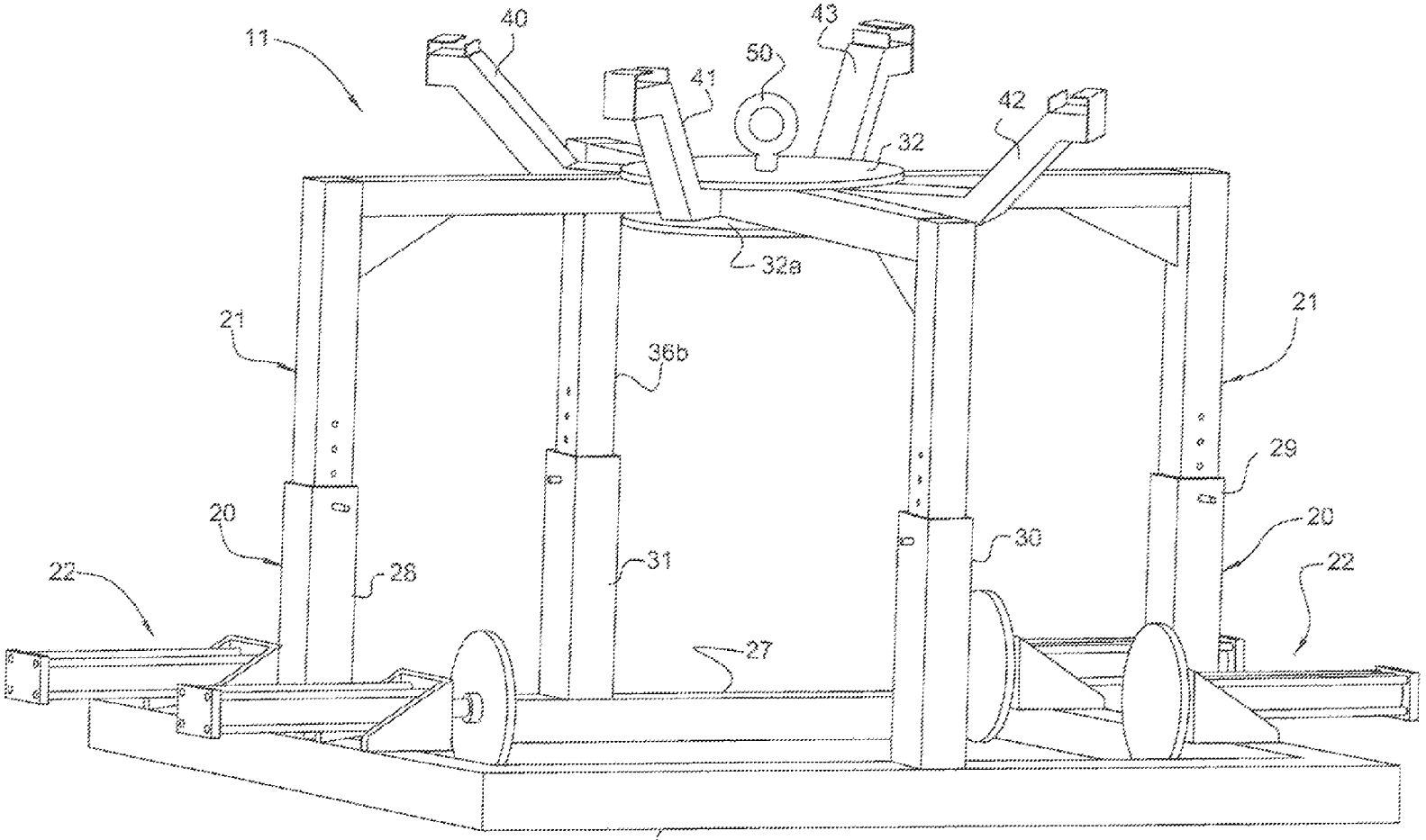
FIG. 1 is a perspective view of a carrier for supporting a flexible bag containing a bulk, comminuted material to be transported.
Figure 2:
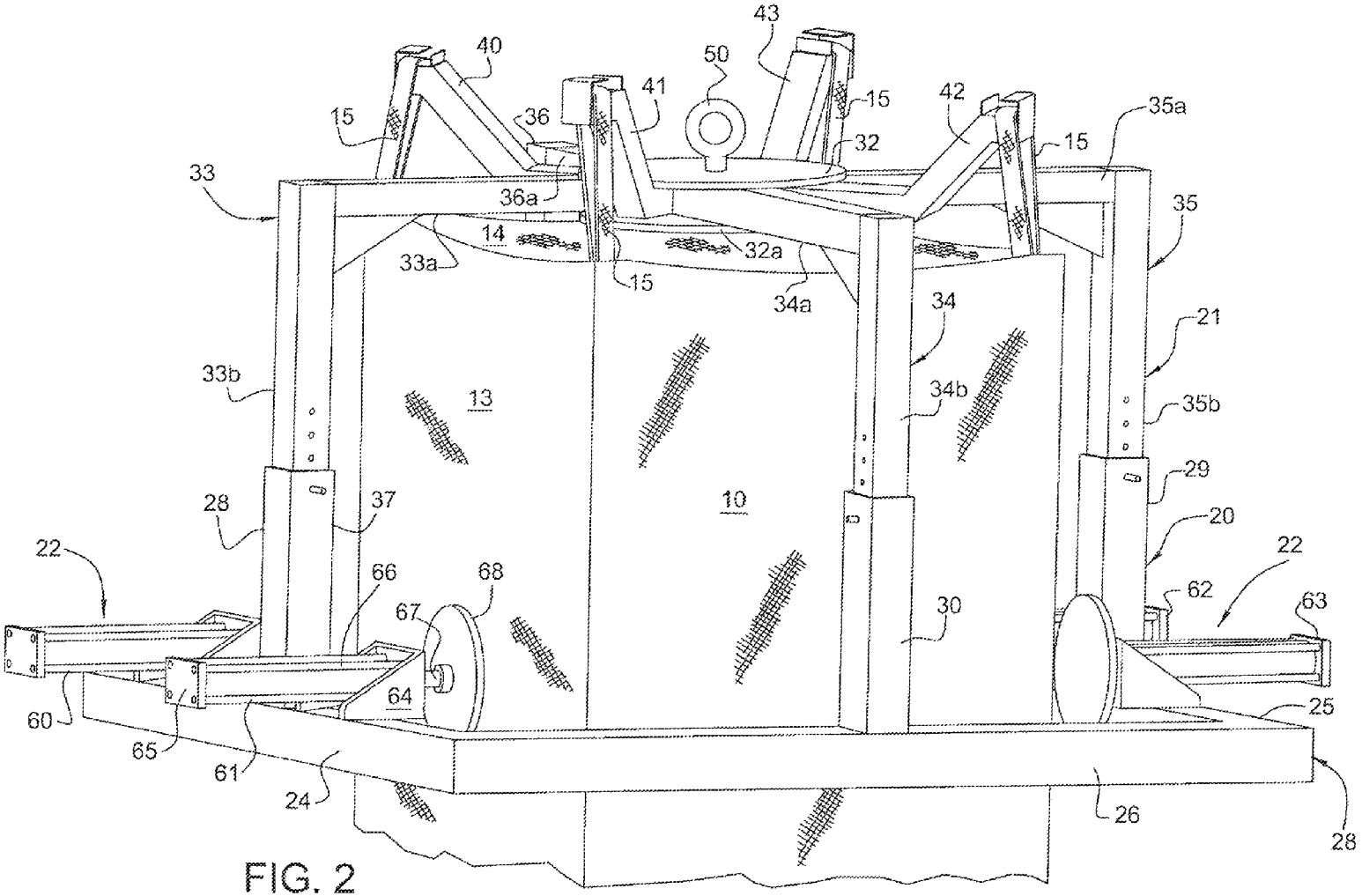
FIG. 2 is a view similar to the view shown in FIG. 1, having a bag consisting of a flexible material containing a bulk, comminuted material disposed within and suspended from such carrier.
Figure 3:
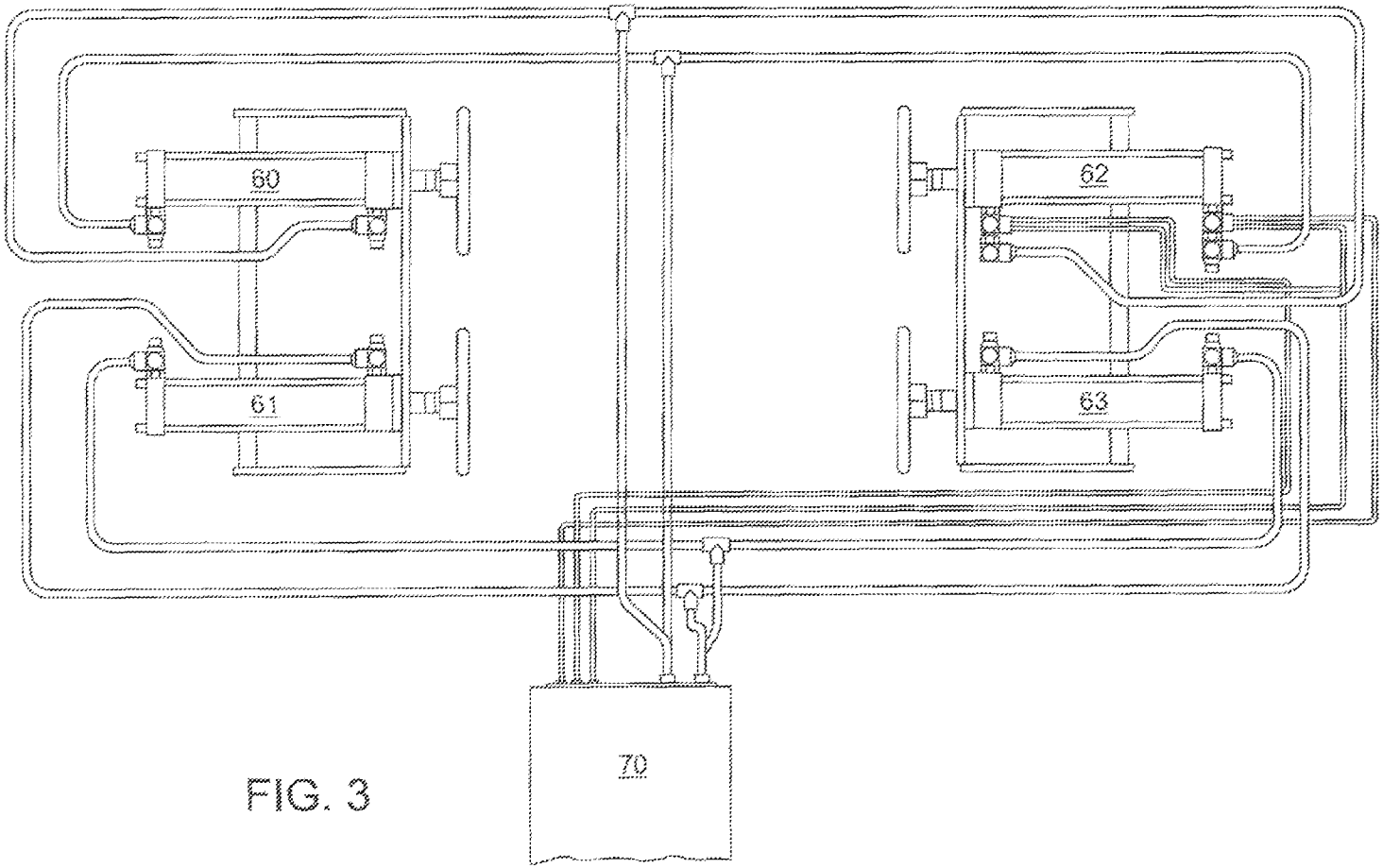
FIG. 3 is a schematic of a system for operating certain devices mounted on the carrier shown in FIGS. 1 and 2 for jostling a bag suspended on a carrier as shown in FIG. 2.

Referring to FIGS. 1 through 3, carrier 11 consists of a lower assembly 20 and upper assembly 21 cooperable with lower assembly 20, and sets of assemblies 22,22 mounted on lower assembly 20 operable for jostling a bag 10 disposed within and suspended from the carrier. Lower carrier assembly 20 includes a peripheral section 23 including a pair of laterally spaced segments 24 and 25 interconnected at their ends by a pair of transversely disposed segments 26 and 27, and a set of upwardly extending segments 28 and 29 disposed at the midsections of segments 24 and 25 and a set of upstanding segments 30 and 31 disposed at the midsections of segments 26 and 27. Upper section 21 consists of a pair of plate members 32 and 32*a* disposed at a vertical centerline of the carrier and in planes perpendicular to such centerline, and a set of circumferentially spaced, radially disposed dog-leg members 33 through 36. Member 33 includes a radially disposed segment 33*a* and a depending segment 33*b* telescopically connected to segment 28, member 34 includes a radially disposed segment 34*a* and a depending segment 34*b* which is telescopically connected to segment 30, member 35 includes a radially disposed segment 35*a* and a depending segment 35*b* telescopically connected to segment 29 and member 36 includes a radially disposed segment 36*a* and a depending segment 36*b* which is telescopically connected to segment 31. Each of such depending segments is provided with a vertically spaced set of pin receiving openings each adapted to register with a comparable opening in one of segments 28 through 31 to receive a pin 37 for fixing the displacement of upper assembly 21 relative to lower assembly 20.

Radial segments 33*a* through 36*a* are rigidly connected to plate members 32 and 32*a*. Also rigidly secured to the underside of plate number 32*a*, disposed between sets of dog-leg members and extending radially is a set of hanger arms 40 through 43. Each of such hanger arms includes a radially disposed segment and a segment extending upwardly at an angle from such radial segment, provided with a laterally extending portion on which a looped strap 15 may be hooked to support bag 13 within the carrier with upper wall 14 thereof disposed immediately below the radially disposed segments of the dog-leg members and the peripheral wall 13 disposed within the depending segments of the dog-leg members with the lower end thereof extending below frame member 23. Plate member 32 further is provided with an attachment 50 positioned on the centerline of the carrier having an eyelet adapted to receive a hook 51 of an overhead crane line 52 as shown in FIG. 4 for lifting, lowering and transporting the carrier.

The system for jostling a bag 10 suspended within carrier 11 includes a first pair of cylinder assemblies 60 and 61 mounted on segment 24 of peripheral member 23, and second set of cylinder assemblies 62 and 63 mounted on segment 25 of peripheral member 23 and disposed in alignment with cylinder assemblies 60 and 61, respectively. As best shown in FIG. 2, cylinder assembly 61 is supported on a u-shaped bracket 64 rigidly secured to an upper surface of segment 24, an end plate 65 and a set of elongated rods 66 interconnecting end plate 65 and bracket 64 with cylinder member 67 disposed between such end plate and mounting bracket. The assembly further includes a piston provided with a rod portion 67 having a bag engageable plate 68 mounted on the end thereof. Cylinder assemblies 60, 62 and 63 are similar to cylinder assembly 61, each containing end plates similar to end plate 68 engageable with the sides of a bag suspended within the carrier. In the conventional manner, such cylinder assemblies are provided with fluid under pressure at the opposite ends of the cylinder portions thereof to reciprocate the pistons thereof and further are provided with a control device 70 as shown in FIG. 3 for directing fluid under pressure to the opposite ends of the cylinder members of such assemblies to reciprocate the piston portions thereof and correspondingly cause the plate members to engage and thus jostle the side portions of a bag suspended within the carrier. The reciprocation of the cylinder assemblies may be accomplished using a 4-way, hand operated air valve or a 4-way electrical solenoid-operated valve, either one under the control of an operator. Alternatively, automatic reciprocation of the cylinder assemblies may be accomplished using a purpose-built control system which operates the cylinder assemblies to simultaneously extend to laterally compress the bag and its contents and to retract the cylinder assemblies to allow the bag to resume its normal shape and allow the flow of the bag's contents, out through the discharge spout. In either arrangement, the cylinder assembly operating force available to apply to the bag is controlled using an air pressure regulator between the compressed air source and the control system for the cylinder assemblies.

Referring to FIG. 4, receptacle 12 may consist of any type of bin or hopper utilized to store, blend or process a material contained in a bag 10. A single receptacle or multiple numbers of such receptacles may be employed within the scope of the invention. They may be positioned in close proximity as shown in FIG. 4 or at displaced areas. Each of such receptacles, however would be provided with an inlet 80 in an upper wall 81 thereof which is provided with a pan configured structure 82 mounted on upper wall 81, about inlet 80. Preferably, such receptacles would be provided with an access opening 83 permitting an operator to reach into the receptacle and untie or otherwise free a closed spout aligned with or extending through an inlet 80, permitting material within such bag to gravity flow into the receptacle.

Typically, a material to be handled would be deposited in a bag 13 having the opening in the upper wall and the spout in the lower wall closed, resting perhaps on a pallet in a storage, production or other area. When such bag is to be transported to a different site to be emptied, an overhead crane having a carrier 11 suspended from a hoist line as shown in FIG. 4 would be used to align the carrier above and about the confines of the bag, and then lower the carrier to a position as shown in FIG. 2 to permit a workman to attached looped straps 15 to arm members 40 through 43 provided on the upper ends of the carrier. With the bag thus attached to the carrier, the carrier with the bag suspended can be hoisted by the overhead crane, transported to a position above a receptacle 12 and lowered onto a pan 82 with the spout portion of the bag vertically aligned with an inlet 80, possibly partially extending therethrough. In positioning and lowering the carrier with the bag suspended thereon, pan structure 82 aids in centering the lower end of the bag within the confines of the receptacle. With the bag thus postured as shown in FIG. 4, an operator can reach through opening 83 in the side wall of the receptacle to free the spout of the bag and thus permit the gravity flow of material into receptacle 12. Once the spout has been opened to permit the free passage of material from the bag into the receptacle, the jostling system may be activated to cause the plate members of the cylinder assemblies to reciprocate as shown in FIG. 6 to dislodge and impel material within the bag, causing it to gravity flow through the spout into the receptacle. Once the bag has been totally emptied, the overhead crane can be used to lift the carrier and depleted bag and transport them to a site where the bag would be detached from the carrier, permitting the carrier to be used in transporting additional bags filled with material to be transported and emptied. In lieu of an overhead crane being used to position a carrier onto a loaded bag at a site remote from a receptacle into which the bag is to be emptied, a forklift truck can be utilized to lift and transport a loaded bag to be emptied from a remote site to a site adjacent a receptacle 12 where such an overhead crane may be utilized as previously described to position the carrier relative to a loaded bag, permitting such bag to be attached to the carrier, and operating the crane to lift and position the bag on a receptacle as previously described.

The advantage of the invention as described is that it eliminates the cost and possibly the congestion resulting in providing a jostling system on every receptacle into which it is intended to deposit material contained in the type of bag as described. By providing the jostling mechanism only on the carrier of a bag, the expense, encumbrance and operation of a plurality of such systems is avoided.

From the foregoing detailed description, it will be evident that there are a number of changes, adaptations and modifications of the present invention, which come within the province of those persons having ordinary skill in the art to which the aforementioned invention pertains. However, it is intended that all such variations not departing from the spirit of the invention be considered as within the scope thereof as limited solely by the appended claims.

We claim:

1. A compact portable carrier for a flexible bag containing comminuted material, provided with a set of straps and an end thereof and a closable spout at another end thereof, comprising:

a lower assembly including a base member disposed peripherally relative to a vertical centerline, and a set of vertical members rigidly mounted on said base member, spaced peripherally about said centerline;

an upper assembly including a support member provided with means for detachably connecting to an overhead member, a set of members attached to said support member spaced peripherally relative to said vertical centerline, each extending laterally and downwardly and having end portions each telescopically connected to a vertical member of said lower assembly;

means provided on each laterally and downwardly extending member of said upper assembly and a telescopically connected vertical member of said lower assembly for fixing interconnections thereof in selective displacements thereof;

means disposed on said support member between each set of laterally and downwardly disposed members of said upper assembly for attaching straps of a flexible bag disposed within said assemblies and suspended from said upper assembly; and means mounted on said lower assembly functional upon operation thereof to engage and jostle a bag depending from said first assembly and depending through said assemblies to enhance the flow and discharge of material within said bag through the spout thereof.

2. A carrier of claim 1 wherein said lower assembly is mountable on a receptacle provided, with an upper support surface with an opening therein having a funnel disposed about a periphery thereof, with a lower portion of said bag engageable with said funnel and the spout thereof aligned with said opening.

3. The carrier of claim 1 wherein each of said laterally and downwardly extending members of said upper assembly includes a portion disposed radially relative to said vertical centerline and a vertical portion telescopically received in one of said vertical member of said lower assembly.

4. The carrier of claim 3 wherein each of said vertical members of said lower assembly includes an opening therein registrable with one of a member of vertically spaced openings in a telescopically inserted vertical portion of a laterally and downwardly extending member for receiving a pin therein in fixing the vertical displacement of said upper assembly relative to said lower assembly.

5. The carrier of claim 3 wherein said support member of said upper assembly includes an upper member provided with means to connect to an overhead hauling means and a lower member, and each of said laterally and downwardly extending members includes a laterally extending portion received between and rigidly secured to said upper and lower members of said support member.

6. The carrier of claim 1 wherein said means operable to engage and jostle said bag comprises at least one fluid activated cylinder assembly having a cylinder member rigidly mounted on said lower assembly and a piston member provided, with an end portion engageable with a bag supported on and depending from said upper assembly.

7. The carrier of claim 6 including at least two of said cylinder assemblies, each mounted on said base member on one side of said vertical centerline.

* * * * *